US007066268B2

(12) United States Patent
Khomynets

(10) Patent No.: US 7,066,268 B2
(45) Date of Patent: Jun. 27, 2006

(54) WELL JET DEVICE FOR WELL TESTING AND DEVELOPING AND THE OPERATING METHOD FOR THE WELL JET DEVICE

(76) Inventor: Zinoviy Dmitrievich Khomynets, d.33, ul. Vilshanetskaya, Tismenitsa, obl. Ivan-Frankovskaya (UA) 77400

( * ) Notice: Subject to any disclaimer, the term of this patent is extended or adjusted under 35 U.S.C. 154(b) by 116 days.

(21) Appl. No.: 10/477,727

(22) PCT Filed: May 28, 2002

(86) PCT No.: PCT/RU02/00261

§ 371 (c)(1),
(2), (4) Date: Nov. 14, 2003

(87) PCT Pub. No.: WO03/006832

PCT Pub. Date: Jan. 23, 2003

(65) Prior Publication Data

US 2004/0129416 A1 Jul. 8, 2004

(30) Foreign Application Priority Data

Jul. 9, 2001 (RU) ..... 2001118926

(51) Int. Cl.
*E21B 43/12* (2006.01)

(52) U.S. Cl. ..... 166/372; 166/68; 166/105

(58) Field of Classification Search ..... 166/105, 166/106, 65.1, 68, 62, 72, 250.01, 370, 372; 417/372

See application file for complete search history.

(56) References Cited

U.S. PATENT DOCUMENTS 2,954,742 A * 10/1960 Williams ..... 166/68
3,716,102 A * 2/1973 Tubbs ..... 166/85.2
4,293,283 A 10/1981 Roeder
4,603,735 A * 8/1986 Black ..... 166/68
4,744,730 A 5/1988 Roeder (Continued)

FOREIGN PATENT DOCUMENTS

RU 2059891 5/1996

(Continued)

*Primary Examiner*—Kenneth Thompson
(74) *Attorney, Agent, or Firm*—Dellett & Walters

(57) ABSTRACT

The invention relates to jet device used for extracting oil from wells. The inventive device comprises a packer, a pipe column, a jet pump, a transmitter and a receiver of physical fields. The body of the pump comprises a through stepped channel embodied in a parallel position with respect to the axes of the pipe column and having a seat disposed between steps for arranging a sealing unit, which is provided with an axial channel. Said pump body is also provided with an active nozzle. The axis of the active nozzle is disposed in a parallel position with respect to the axis of the through channel at a distance equal to or higher than 1.1 of the radius thereof. The diameter of the through channel above the seat is 0.5 mm greater than the diameter thereof below said seat. The diameter of the axial channel of the sealing unit is equal to or less than 0.6 of the external diameter thereof. The sealing unit is arranged in such a way that it is movable along a cable above a bit and successfully replaceable by the following functional inserts: a blocking insert, depression insert etc. Said inserts are provided with attachments for transporting them to the pump and extracting therefrom and for arranging instruments and samplers thereon. Said invention makes it possible to optimise the dimensions of the elements of the device and increases the reliability thereof.

2 Claims, 2 Drawing Sheets

U.S. PATENT DOCUMENTS 4,988,389 A * 1/1991 Adamache et al. ..... 166/302
6,135,210 A * 10/2000 Rivas ..... 166/372

FOREIGN PATENT DOCUMENTS

RU 2121610 11/1998

* cited by examiner

WELL JET DEVICE FOR WELL TESTING AND DEVELOPING AND THE OPERATING METHOD FOR THE WELL JET DEVICE

FIELD OF INVENTION

This invention relates to the field of pumping engineering, mainly to well jet devices for oil production and intensification of oil inflow from wells.

PRIOR ART

Known in the art is a well jet device comprising a jet pump installed on the piping string in the well and a transmitter and a receiver-transducer arranged below the jet pump (RU 2129671 C1).

From the above source known is a method of operation of a well jet device, which includes lowering in the well a piping string with a jet pump, a packer and a transmitter and a receiver-transducer of physical fields, the latter being arranged below the jet pump.

The known device and method enable to explore wells and pump various extracted media, e.g., oil, out of wells, at the same time exploring the well, the transmitter and receiver of physical fields being arranged with the possibility of moving back and forth along the well relative to the jet pump and the stratum.

But in some cases this is insufficient for obtaining reliable information on the well condition, which reduces the efficiency of works performed in order to intensify oil production.

The closest, as to its technical essence and the achievable result, to this invention in the part of the device as the object of the invention is a well jet device for testing and developing wells, which comprises a packer, a piping string and a jet pump, the body of the said pump comprising an active nozzle with a mixing chamber and having a stepped through passage with a mounting seat between steps for installing a sealing assembly with an axial passage, the said well jet device being provided with an transmitter and receiver-transducer of physical fields, which is arranged on the jet pump side for entry of the medium pumped out of the well, the output side of the jet pump is connected to the space surrounding the piping string, the jet pump passage side for entry of the pumped out medium is connected to the inner cavity of the piping string below the sealing assembly, the input side of the passage for supplying the working medium to the active nozzle is connected to the inner cavity of the piping string above the sealing assembly, and the through passage of the jet pump is made parallel to the axis of the piping string (RU 2059891 C1).

The closest, as to its technical essence and the achievable result, to this invention in the part of the method is the method of operation of a well jet device, which includes installation, on the piping string, of a packer and a jet pump, in the body of which a through passage is made with a mounting seat, lowering of the whole assembly into the well, release of the packer and arrangement of a transmitter and a receiver-transducer of physical fields below the jet pump (RU 2121610 C1).

The known well jet device and the method of operation of the well jet device enable to carry out various process operations in the well below the level at which the jet pump is installed, including those performed by lowering pressure difference above and below the sealing assembly.

But, the known well jet device and the method of operation do not enable to exploit the potential of the device in full due to non-optimal sequence of operations and dimension relations of various structural elements of the well jet device.

DISCLOSURE OF INVENTION

The objective of this invention is to optimize the dimensions of various components of the construction of the well jet device and the sequence of operations when carrying out works on intensifying the well exploitation and, owing to it, to raise the efficiency of well jet device operation in developing and testing wells.

The stated objective in the part of the device as the object of the invention is achieved owing to the fact that the well jet device comprises a packer, a piping string and a jet pump, in the body of which an active nozzle with a mixing chamber are arranged and a stepped through passage is made with a mounting seat between steps for installing a sealing assembly having an axial channel, the said device being provided with a transmitter and a receiver-transducer of physical fields, which is arranged at the jet pump side for entry of the medium pumped out of the well, the jet pump output side is connected to the space around the piping string, the input side of the jet pump passage for supplying the pumped out medium is connected to the inner cavity of the piping string below the sealing assembly, and the input side of the passage for supplying the working medium to the active nozzle is connected to the inner cavity of the piping string above the sealing assembly, and the through passage of the jet pump is made parallel to the axis of the piping string, the axis of the active nozzle being parallel to the axis of the through passage and being located at a distance equal at least 1.1 radii of the bigger step of the through passage from the latter; the diameter of the bigger step in the through passage, which is located above the mounting seat, is at least 0.5 mm greater than the diameter of the step in the through passage, which is located below the mounting seat; the sealing assembly is arranged on the well-logging cable or on a wire fed through the axial passage and installed with the possibility of being replaced, e.g., in turns, by the functional inserts, namely, a hydrostatic testing insert, a depression insert, a blocking insert, an insert for recording stratum pressure restoration curves and an insert for hydrodynamic impact on the stratum; the diameter of the axial passage in the sealing assembly is not greater than 0.6 outer diameter of the sealing assembly; the axes of the sealing assembly and the functional inserts are aligned with the axis of the through passage in the jet pump; the functional inserts are made with the possibility of installing on them autonomous well instruments and sampling devices and are made with a tool for delivery and removal of them from the jet pump with the use of cable equipment, the sealing assembly being installed with the possibility of moving it along the well-logging cable or a wire above the cap on which the transmitter and receiver-transducer of physical fields is arranged, the latter being connected to the well-logging cable cap with the possibility of being replaced by other well instruments, e.g., a perforator, an ultrasonic transmitter, a sampling device, a thermometer, a pressure gauge, which all may be connected, either in turns or jointly, to the well-logging cable or a wire.

The stated objective in the part of the method as the object of the invention is achieved owing to the fact that in the method of operation of the well jet unit includes installation on the piping string of a packer and a jet pump having a through passage with a mounting seat, lowering of that assembly into the well, release of the packer and arrangement in the well, below the jet pump, of a transmitter and receiver-transducer of physical fields, the said transmitter and receiver-transducer of physical fields being lowered together with a sealing assembly arranged on the well-logging cable or a wire above the cap on which with the transmitter and receiver-transducer is installed, when lowering into the well, the transmitter and receiver-transducer of physical fields is used for background measurements of temperature and other physical fields before the well bottom, the sealing assembly is installed onto the mounting seat in the through passage without impeding the back and forth motion of the well-logging cable or wire, then the transmitter and receiver-transducer of physical fields is arranged in the stratum interval under exploration and, by supplying the working medium to the nozzle of the jet pump, several values of pressure drawdown on the stratum are successively created, and, at each its value, bottom-hole pressures, compositions of the fluid coming from the stratum and the well flow rate are measured, after which the parameters of physical fields are recorded by moving the transmitter and receiver-transducer of physical fields along the well axis in the speed range from 0.1 to 100 meters per minute and at bottom-hole pressures changing stepwise from the stratum pressure to 0.01 stratum pressure, the transmitter and receiver transformer of physical fields being moved along the well axis both when the jet pump is operated and when it is shut down, then the transmitter and receiver-transducer of physical fields is lifted out of the well, and the functional insert for recording stratum pressure restoration curves is lowered, the said insert being provided with a pressure sensor and a sampling device, installed in the through passage of the jet pump, a required pressure drawdown on the stratum is created with the use of the jet pump, and, after sharp stopping of supplying the liquid working medium to the jet pump, a stratum pressure restoration curve for the well zone under the packer is recorded, said recording of stratum pressure restoration curves may be done repeatedly at different pressure drawdown on the stratum; after that the results are processed, and a decision is taken whether repair works on the well are necessary, such works being conducted with the use of the jet pump and the alternatively applied functional inserts being lowered into the well with the sealing assembly on the well-logging cable or a wire and with, e.g., a perforator, an ultrasonic transmitter, a sampling device, a thermometer and a pressure gauge, and after completion of the said works the cycle of well exploration is repeated.

The analysis of the well jet device has shown that the reliability and efficiency of its operation may be improved both by making various components of the device under strictly defined dimensions and by carrying out works in the well in a strictly defined succession. During the operation of the device different well modes are studied. It is required to install and remove the sealing assembly, to move the transmitter and receiver-transducer of physical fields along the well. It has been found that it is advisable to make the diameter of the bigger step in the through passage, which is located above the mounting seat for the sealing assembly, at least 0.5 mm greater than the diameter of the step in the through passage, which is located below the mounting seat, and the diameter of the axial passage in the sealing assembly should not exceed 0.6 outer diameter of the sealing assembly. In the result, the sealing assembly is securely installed on the mounting seat and possible overflows through the sealing assembly are minimized. The arrangement of the active nozzle axis at a distance equal at least 1.1 radii of the bigger step in the through passage, when making the nozzle axis parallel to the axis of the through passage, enables to determine the least possible distance between the axis of the nozzle and that of the through passage of the jet pump and, consequently, enables to determine the maximum permissible dimensions of the jet pump body that is of much importance, since the diameter of the well is the main limiting factor when arranging equipment in the well. The possibility of replacing the sealing assembly with other functional inserts and the possibility of placing, instead of the transmitter and receiver-transducer of physical fields, other well instruments, in particular a perforator, an ultrasonic transmitter, a sampling device, a thermometer, a pressure gauge, etc., enables to conduct various works, e.g., to pressure-test the packer, transfer the well in the flow mode, conduct works on perforating the productive stratum and perform other operations without lifting the jet pump and the piping string from the well. In the result, the possibilities of the well jet device in conducting studies and repair and restoration works in the well are expanded and the time necessary for such works is shortened. Making of inserts with the axis aligned with the axis of the through passage enables to reduce the possibility of inserts being stuck in the process of their installation or removal, which increases the reliability of operation of the well jet device.

Of no lesser importance is the rational organization of works aimed at exploring the well, which enable to obtain more adequate information on the condition of the well and the productive stratum, and, due to it, accelerate the process of restoring the well output. In particular, background measurements of temperature and other physical fields in the operation of lowering the transmitter and receiver-transducer of physical fields enable to get, prior to initiating inflow from the stratum, preliminary data on the present condition of the well, which makes it possible to elaborate practical measures for exploring the well and more adequately interpret the well exploration results in the mode of inflow from the stratum. Moving the transmitter and receiver-transducer of physical fields along the well, especially in the area of the productive stratum, both when the jet pump is operated or when it is shut down, enables to take dynamic and static characteristics of the well. In the course of exploration it has been found that adequate accuracy of obtained data may be obtained when moving the transmitter and receiver-transducer of physical fields with the speed from 0.1 to 100 meters per minute and at changing bottom-hole pressure stepwise in the range from the normal stratum pressure to 0.01 stratum pressure. The installation of the functional inserts enables, apart from the above-stated possibilities, to organize different modes of well operation, in particular, it becomes possible not only to get data on the composition of the fluid coming from the productive stratum, but also take important characteristics of the well, such as record a stratum pressure restoration curve in the area below the packer, this possibility being achieved due to reduction in the bottom-hole pressure up to a value being 0.01 of nominal and subsequent sharp stopping of supply of the liquid working medium to the nozzle of the jet pump, and, what is most important, the well jet device enables to make recordings repeatedly at various modes in the above-stated range. As the result, the reliability of the obtained data is significantly improved. All the above-indicated works may be conducted without numerous re-installations of the equipment in the well, which improves the efficiency of the well jet device greatly. After the completion of a cycle of the works on exploring and restoring the well workability, the whole cycle may be repeated, also without the necessity to re-install the equipment in the well. Thus, the scope of investigations carried out in the well has been expanded, which is of importance when carrying out restoration works.

In the result, the objective of the invention—to optimize-the succession of operations and the dimensions of various components of the well jet device—has been achieved, and, owing to that, the efficiency of operation of the well jet device has been improved.

PREFERRED EMBODIMENT OF THE INVENTION

Figure 1:
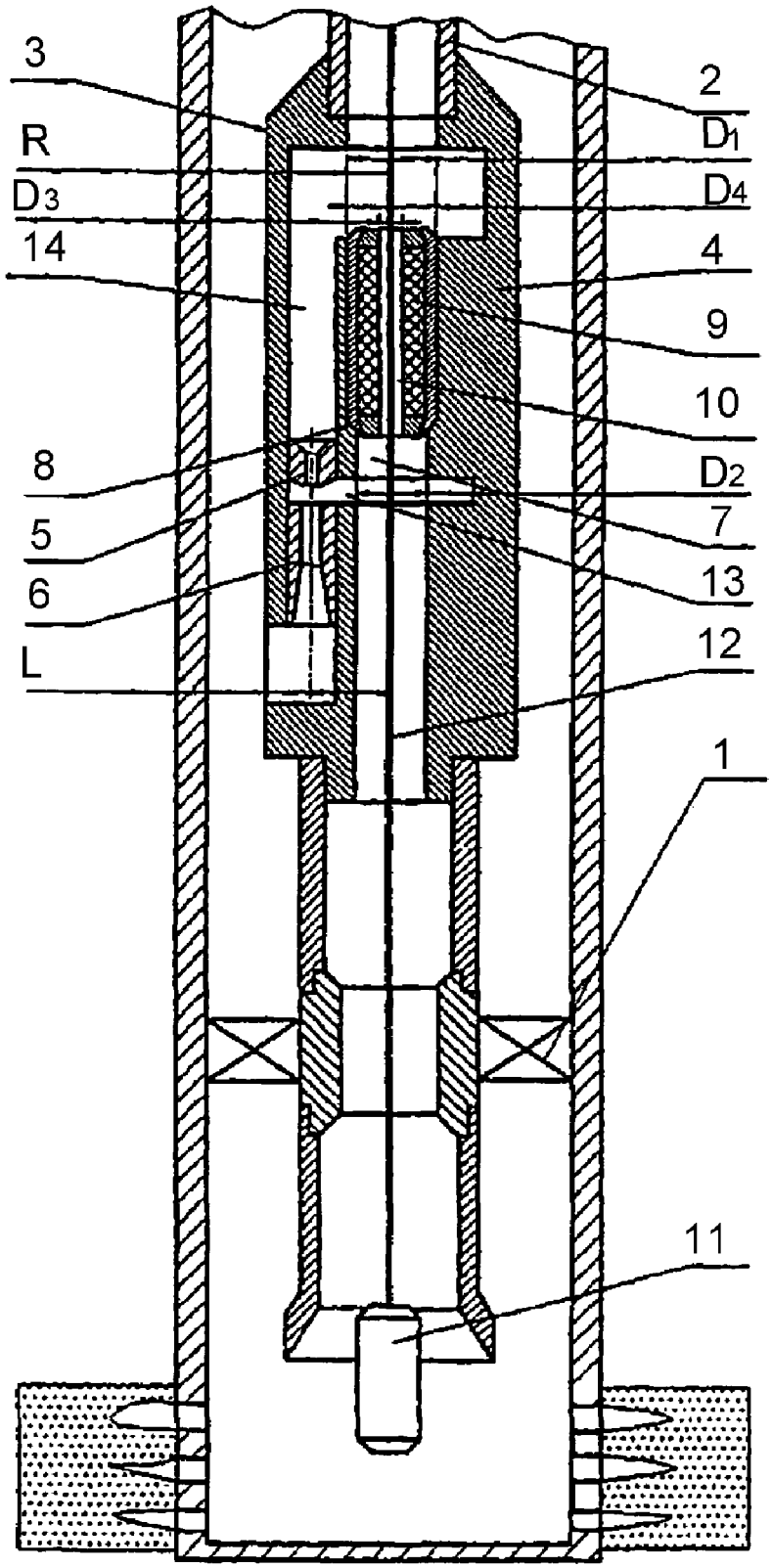
FIG. 1 is a longitudinal section of the well jet device described herein.
Figure 2:
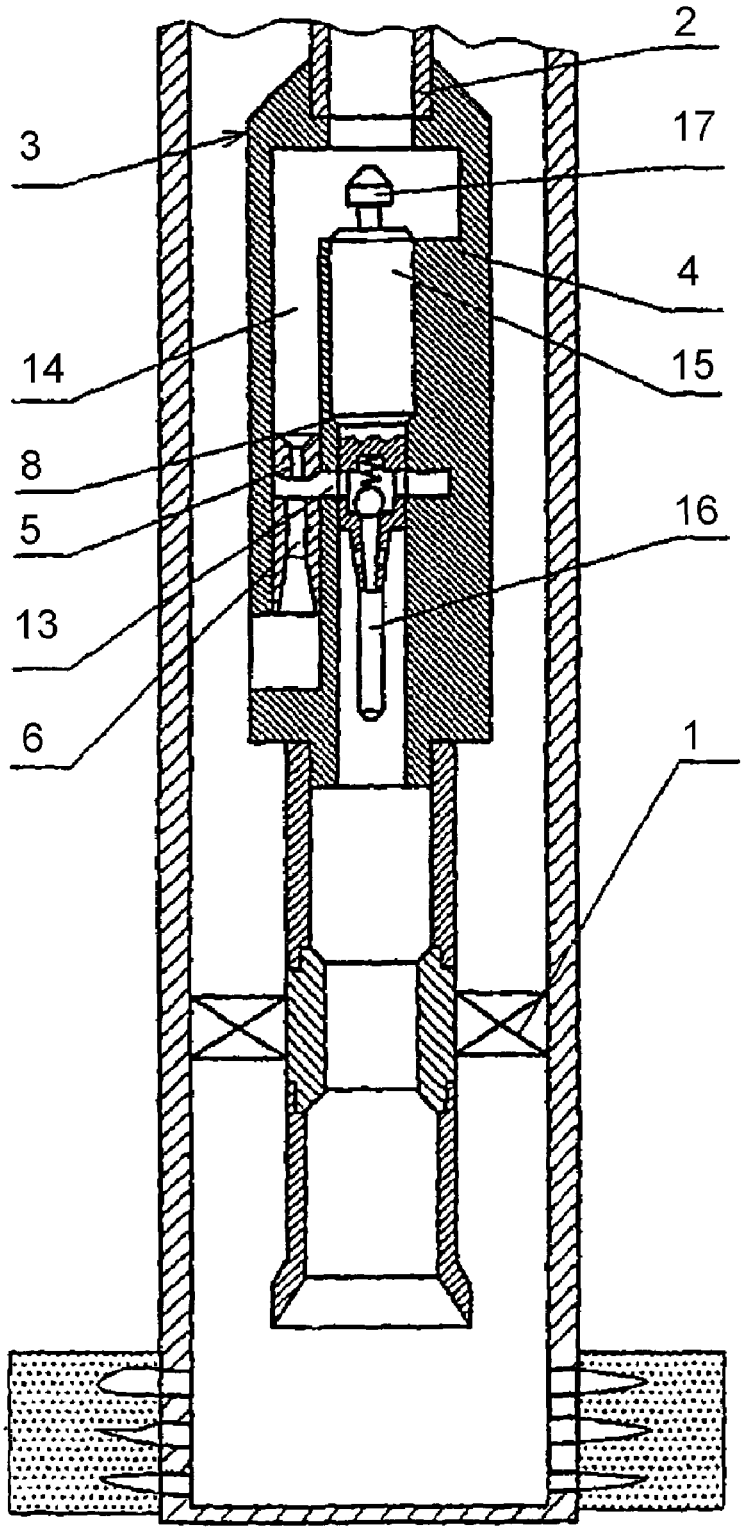
FIG. 2 is a longitudinal section of the well jet device with a functional insert installed in the through passage.

The proposed well jet device for testing and developing wells, which is served to implement the described method, comprises the packer 1, the piping string 2 and the jet pump 3, in the body 4 of which the active nozzle 5 with the mixing chamber 6 are axially arranged and the stepped through passage 7 is made with the mounting seat 8 between steps for installing the sealing assembly 9 having the axial channel 10, the said device being provided with the transmitter and receiver-transducer of physical fields 11, which is arranged on the side of the jet pump 3 for entry of the medium pumped out of the well and installed on the cable 12 (or a wire) fed through the axial passage 10 of the sealing assembly 9. The output side of the jet pump 3 is connected to the space around the piping string 2, the input side of the passage 13 in the jet pump 3 for supplying the pumped out medium is connected to the inner cavity of the piping string 2 below the sealing assembly 9, and the input side of the passage 14 for supplying the working medium to the active nozzle 5 is connected to the inner cavity of the piping string 2 above the sealing assembly 9. The through passage 7 of the jet pump 3 is made parallel to the axis of the piping string 2, the diameter $D_1$ of the bigger step in the through passage 7, which is located above the mounting seat 8 is at least 0.5 mm greater than the diameter $D_2$ of the step in the through passage 7, which is located below the mounting seat 8, the axis of the active nozzle 5 is parallel to the axis of the through passage 7 and is located at a distance L equal at least 1.1 radii R of the bigger step of the through passage 7; the sealing assembly 9 is installed with the possibility of being replaced, e.g., in turns, by the functional inserts 15, namely, a hydrostatic testing insert, a depression insert, a blocking insert an insert for recording stratum pressure restoration curves and an insert for hydrodynamic impact on the stratum; the axes of the sealing assembly 9 and the functional inserts 15 are in alignment with the axis of the through passage 7 in the jet pump 3; the diameter $D_3$ of the axial passage 10 in the sealing assembly 9 is not greater than 0.6 outer diameter $D_4$ of the sealing assembly 9; the functional inserts 15 are made with the possibility of installing on them autonomous well instruments and sampling devices 16 and are made with a tool 17 for delivery and removal of them from the jet pump 3 with the use of cable equipment, the sealing assembly 9 being installed with the possibility of moving it along the well-logging cable 12 (or a wire) above the attachment cap (not shown) on which the transmitter and receiver-transducer of physical fields 11 is arranged, the latter being made with the possibility of operating it in the area under the packer 1 when the jet pump 3 is operated and when it is shut down and being connected to the cap of the well-logging cable 12 (or a wire) with the possibility of being replaced by other well instruments, e.g., a perforator, an ultrasonic transmitter, a sampling device, a thermometer, a pressure gauge, which all may be connected, either in turns or jointly, to the well-logging cable or a wire.

The described method of operation is implemented as follows.

The jet pump 3 and the packer 1 on the piping string 2 are lowered into the well and arranged above the productive stratum. The packer 1 is put into the operating position (release of the packer 1), thus separating the space surrounding the piping string 2 in the well. The sealing assembly 9 and the transmitter and receiver-transducer of physical fields 11 are lowered on the cable 12, the sealing assembly being put into position on the mounting seat 8 in the through passage 7 and the transmitter and receiver-transducer being arranged below the jet pump 3. The sealing assembly 9 separates back and forth movements of the well-logging cable 12 or a wire. When being lowered into the well, the transmitter and receiver-transducer of physical fields 11 is used for background measurements of temperature and other physical fields in the space before the well bottom (productive stratum). Thus, the transmitter and receiver-transducer of physical fields 11 is arranged in the stratum interval under exploration. The working medium, e.g., water, salt solution, oil, etc., is pumped in through the piping string 2. From the piping string 2 the working medium flows through the passage 14 to the active nozzle 5 of the jet pump 3. Within a few seconds after pumping the working medium through the active nozzle 5 a stable jet is formed at the outlet of the nozzle and, flowing out of the nozzle 5, entrains the surrounding medium into the jet pump, which results in a pressure reduction first in the passage 13 for supplying of the pumped out medium and then in the under-packer space of the well. In the result, the stratum medium flows to the jet pump 3 through a section of the piping string 2 below the sealing assembly 9 and through the passage 13, where it is mixed with the working medium, and the medium mixture flows from the well to the surface through the hole clearance around the piping string 2 due to the energy of the working medium. During pumping out several values of pressure drawdown on the productive stratum are successively created. At each value of the pressure drawdown the well-bottom pressure, the composition of the fluid coming from the stratum and the well output are registered. After that the parameters of physical fields are recorded while moving the transmitter and receiver-transducer of physical fields 11 along the well with the speed from 0.1 to 100 meters per minute and at the well-bottom pressures changing stepwise from the normal stratum pressure to 0.01 stratum pressure. The transmitter and receiver-transducer of physical fields is thus moved both when the jet pump 3 is operated and when it is shut down. Then the transmitter and receiver-transducer of physical fields 11 is removed from the well, and the functional insert 15, which is provided with a pressure sensor and a sampling device 16, is lowered on the well-logging cable 12 or a wire for the purpose of recording stratum pressure restoration curves, and installed in the through passage 7 of the jet pump 3. With the use of the jet pump 3 a required pressure drawdown on the stratum is created, and, after sharp stopping of supply of the liquid working medium to the jet pump 3, a stratum pressure restoration curve for the under-packer well space is registered. Recording of stratum pressure restoration curves may be done repeatedly at different values of the pressure drawdown on the stratum. Then the obtained measurements are processed, and a decision may be taken whether repairs of the well are necessary, which are conducted with the use of the jet pump 3 and alternatively changed functional inserts 15 as well with the use of instruments lowered into the well with the sealing assembly 9 on the well-logging cable .12 (or a wire), e.g., a perforator, an ultrasonic transmitter, a sampling device, a thermometer or a pressure gauge. Depending on the performed operations, a blocking insert, a depression insert or a hydrostatic testing insert may be installed on the mounting seat 8 in the through passage 7. A blocking insert is used for closing the passages in the jet pump 3 and ensuring the well operation in the flow mode. A depression insert is used for separation of the piping string 2, which ensures the operation of the jet pump 3. A hydrostatic testing insert is used for pressure testing of the well and the packer. After completion of the above-indicated works the whole cycle of well exploration may be repeated, if necessary.

INDUSTRIAL APPLICABILITY

This invention may be used in testing, developing, operating and conducting work-over of oil and gas condensate wells, as well as in other industries where various media are extracted out of wells.

What is claimed is:

1. The well jet device comprising a packer, a piping string and a jet pump, in a body of which an active nozzle with a mixing chamber are arranged and a stepped through passage is made with a mounting seat between steps for installing a sealing assembly having an axial passage, said device being provided with a transmitter and a receiver-transducer of physical fields, which is arranged at the jet pump side for entry of medium pumped out of the well, the jet pump output side is connected to space around the piping string, the input side of the jet pump passage for supplying the pumped out medium is connected to an inner cavity of the piping string below the sealing assembly, and the input side of the passage for supplying the working medium to the active nozzle is connected to the inner cavity of the piping string above the sealing assembly, and the through passage of the jet pump is made parallel to the axis of the piping string, characterized in that the axis of the active nozzle is parallel to the axis of the through passage and being located from the latter's axis at a distance equal to at least 1.1 radii of the bigger step of the through passage, the diameter of the bigger step in the through passage, which is located above the mounting seat, is at least 0.5 mm greater than the diameter of the step in the through passage, which is located below the mounting seat; the sealing assembly is arranged on a well-logging cable or on a wire fed through the axial passage and replaceable by functional inserts, including at least one of a hydrostatic testing insert, a depression insert, a blocking insert, an insert for recording stratum pressure restoration curves and an insert for hydrodynamic impact on the stratum; the diameter of the axial passage in the sealing assembly is not greater than 0.6 outer diameter of the sealing assembly; the axes of the sealing assembly and the functional inserts are aligned with the axis of the through passage in the jet pump; the functional inserts are adapted for installation thereon autonomous well instruments and sampling devices and are made with a tool for delivery and removal of the same from the jet pump with the use of cable equipment, the sealing assembly being installed moveably along the well-logging cable or a wire above a cap on which a transmitter and receiver-transducer of physical fields are arranged, the latter being connected to the well-logging cable cap replaceable by other well instruments, including at least one of a perforator, an ultrasonic transmitter, a sampling device, a thermometer, a pressure gauge, which all may be connected, either in turns or jointly, to the well-logging cable or a wire.

2. The method of operation of the well jet unit, including installation on a piping string of a packer and a jet pump having a through passage with a mounting seat, lowering of that assembly into the well, releasing the packer and arrangement in the well, below the jet pump, of a transmitter and receiver-transducer of physical fields, characterized in lowering said transmitter and receiver-transducer of physical fields together with a sealing assembly arranged on a well-logging cable or a wire above a cap with the transmitter and receiver-transducer connected to the latter, when lowering into the well, using the transmitter and receiver-transducer of physical fields for background measurements of temperature and other physical fields before the well bottom, installing the sealing assembly onto the mounting seat in the through passage without impeding the back and forth motion of the well-logging cable or wire, then arranging the transmitter and receiver-transducer of physical fields in a stratum interval under exploration and, by supplying working medium to the nozzle of the jet pump, successively creating several values of pressure drawdown on the stratum and, at each of said several values, measuring bottom-hole pressures, compositions of the fluid coming from the stratum and the well flow rate, after which, recording the parameters of physical fields by moving the transmitter and receiver-transducer of physical fields along the well axis in the speed range from 0.1 to 100 meters per minute and at bottom-hole pressures changing stepwise from the stratum pressure to 0.01 stratum pressure, said moving being performed along the well axis both when the jet pump is operated and when it is shut down; then lifting the transmitter and receiver-transducer of physical fields out of well, and lowering the functional insert for recording stratum pressure restoration providing said insert with a pressure sensor and a sampling device, installed in the through passage of the jet pump, creating a required pressure drawdown on the stratum with the use of the jet pump, and, sharply stopping of supplying the liquid working medium to the jet pump and thereafter, recording a stratum pressure restoration curve for the well zone under the packer wherein said recording of stratum pressure restoration curves done repeatedly at different pressure drawdown on the stratum; thereafter, processing the results and taking a decision whether repair works on the well are necessary, such works being conducted with the use of the jet pump and alternatively applied functional inserts being lowered into the well with the sealing assembly on the well-logging cable or wire and including at least one of a perforator, an ultrasonic transmitter, a sampling device, a thermometer and a pressure gauge; after completion of the said works the cycle of well exploration is repeated.

* * * * *